US008914938B1

(12) United States Patent
Lee

(10) Patent No.: US 8,914,938 B1
(45) Date of Patent: Dec. 23, 2014

(54) MUNICIPAL SEWER CLEANING SYSTEM

(71) Applicant: Calvin E. Lee, Union City, GA (US)

(72) Inventor: Calvin E. Lee, Union City, GA (US)

( * ) Notice: Subject to any disclaimer, the term of this patent is extended or adjusted under 35 U.S.C. 154(b) by 0 days.

(21) Appl. No.: 14/030,080

(22) Filed: Sep. 18, 2013

(51) Int. Cl.
*A47L 7/00* (2006.01)
*B08B 9/00* (2006.01)
*E03F 9/00* (2006.01)

(52) U.S. Cl.
CPC ..... *E03F 9/00* (2013.01)
USPC ..... 15/320; 15/322; 134/168 R; 134/168 C

(58) Field of Classification Search
USPC ..... 15/320, 322, 340.1; 134/168 R, 168 C, 134/167 C, 172, 176, 186
IPC ..... A47L 7/00; B08B 9/00
See application file for complete search history.

(56) References Cited

U.S. PATENT DOCUMENTS

| | | | | |
|---|---|---|---|---|
| 3,658,589 | A | 4/1972 | Shaddock | |
| 3,661,261 | A | 5/1972 | Lemke | |
| 4,322,868 | A | 4/1982 | Wurster | |
| D348,961 | S | 7/1994 | Kimes | |
| 5,336,333 | A | 8/1994 | Sheppard et al. | |
| 5,435,854 | A * | 7/1995 | Derlein | 134/22.11 |
| 6,702,939 | B2 | 3/2004 | Thompson et al. | |
| 7,604,023 | B2 * | 10/2009 | Buckner et al. | 137/899.4 |

* cited by examiner

*Primary Examiner* — David Redding

(57) ABSTRACT

A municipal sewer cleaning system for efficiently cleaning a below grade municipal sewer line features a vacuum service truck having a vacuum source fluidly connected to a flexible vacuum hose, a compressed air source fluidly connected to a flexible air hose, and a pressurized water source fluidly connected to a flexible water hose. The system features a collar assembly having a rigid inner collar and an inflatable outer collar connected to the air hose. A tapering semi-cylindrical skirt is Ideated on a collar second end and a rigid ninety degree reducing elbow is located on a collar first end. The reducing elbow is fluidly connected to the vacuum hose and features a trough located on an elbow outside wall with a plurality of roller units inside. The water hose slides within the plurality of roller units.

6 Claims, 4 Drawing Sheets

MUNICIPAL SEWER CLEANING SYSTEM

FIELD OF THE INVENTION

The present invention relates to industrial vacuum systems, or more specifically, municipal sewage vacuum systems.

BACKGROUND OF THE INVENTION

Vacuum trucks are widely used for cleaning out sewage tanks and sewage lines where silt and debris build up and inhibit the performance of the sewage system. The vacuuming process is very messy as water is used to create a slurry from the silt and debris for vacuuming by the vacuum truck. With the silt and debris in slurry form, it becomes much easier for the silt and debris to travel into undesired places. The present invention features a municipal sewer cleaning system for efficiently cleaning a below grade municipal sewer line. The present invention improves the efficiency and reduces the messiness of the system by containing the slurry before it is vacuumed into the vacuum truck.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

The present invention features a municipal sewer cleaning system for efficiently cleaning a below grade municipal sewer line. In some embodiments, the system comprises a vacuum service truck having a vacuum source fluidly connected to a flexible vacuum hose. In some embodiments, the vacuum service truck comprises a compressed air source fluidly connected to a flexible air hose. In some embodiments, the vacuum service truck comprises a pressurized water source fluidly connected to a flexible water hose. In some embodiments, the vacuum hose, the air hose, and the water hose are collectively joined into a hose assembly designed to extend into the below grade sewer line.

In some embodiments, the system comprises a collar assembly having a rigid inner collar and an inflatable outer collar. In some embodiments, the inflatable outer collar comprises a quick connect fitting connected to the air hose. In some embodiments, the system comprises a tapering semi-cylindrical skirt located on a collar second end.

In some embodiments, the system comprises a rigid ninety degree reducing elbow fluidly connected to the vacuum hose. In some embodiments, an elbow second end is fluidly connected to a collar first end. In some embodiments, the reducing elbow comprises a trough located on an elbow outside wall having a plurality of roller units located therein. In some embodiments, the water hose is located in the trough through the plurality of roller units.

DESCRIPTION OF PREFERRED EMBODIMENTS

Figure 1:
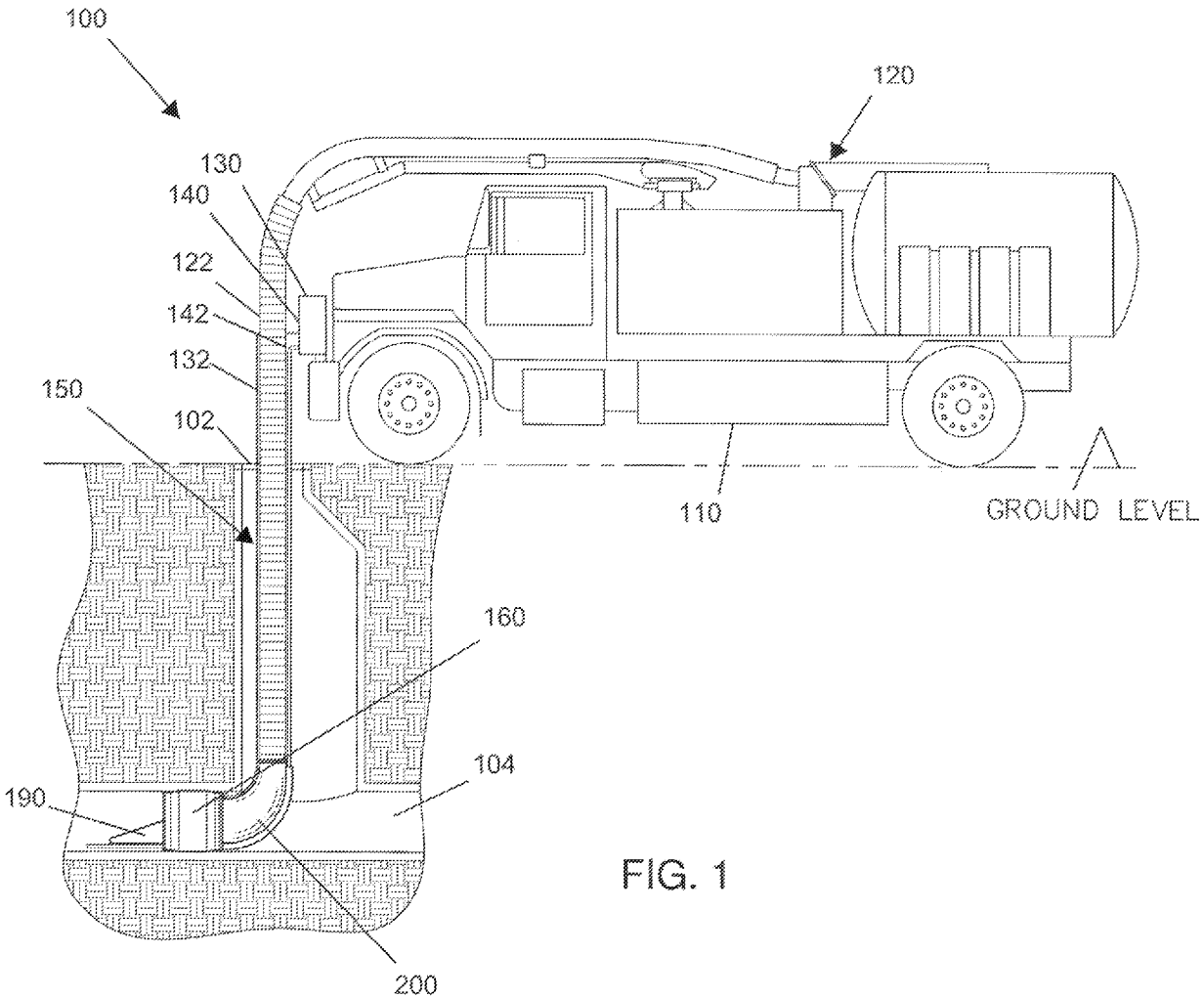
FIG. 1 shows an overall view of the present invention.
Figure 2:
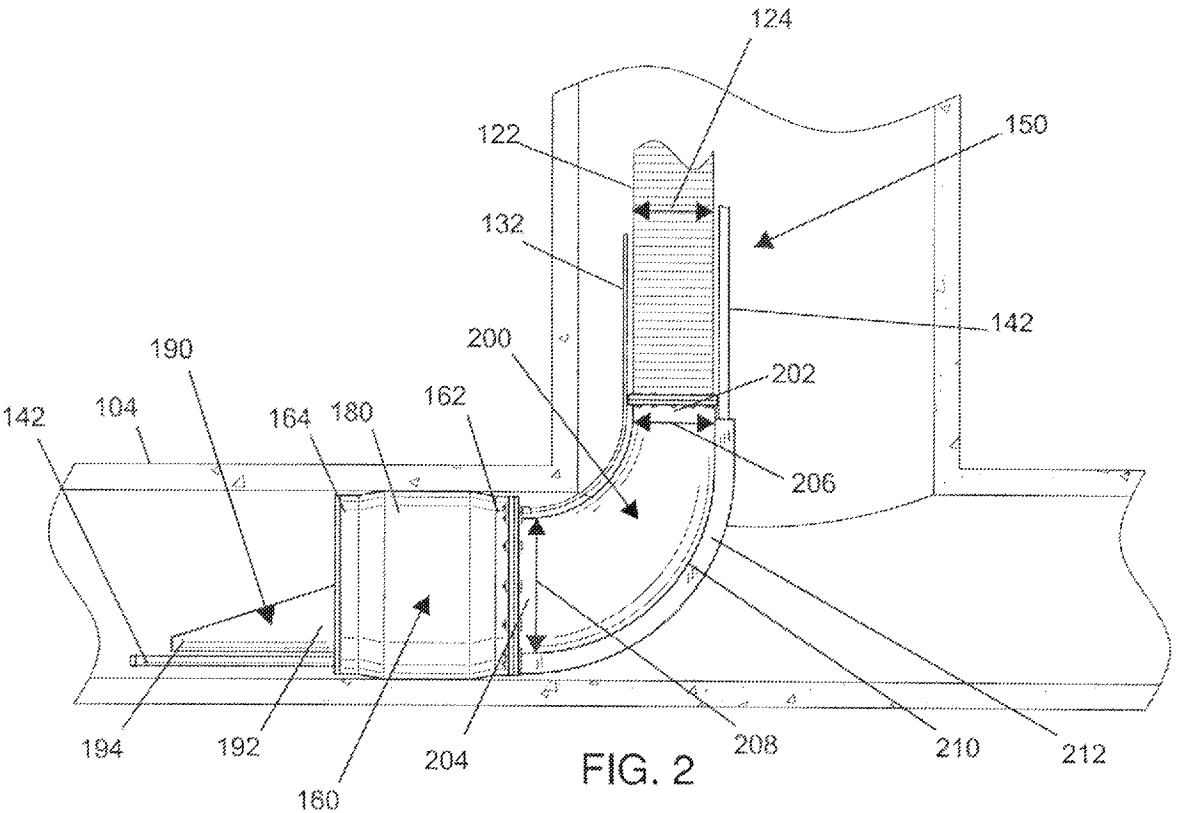
FIG. 2 shows a close-up view of the hose assembly, the reducing elbow, the collar assembly, and the skirt of the present invention.
Figure 3:
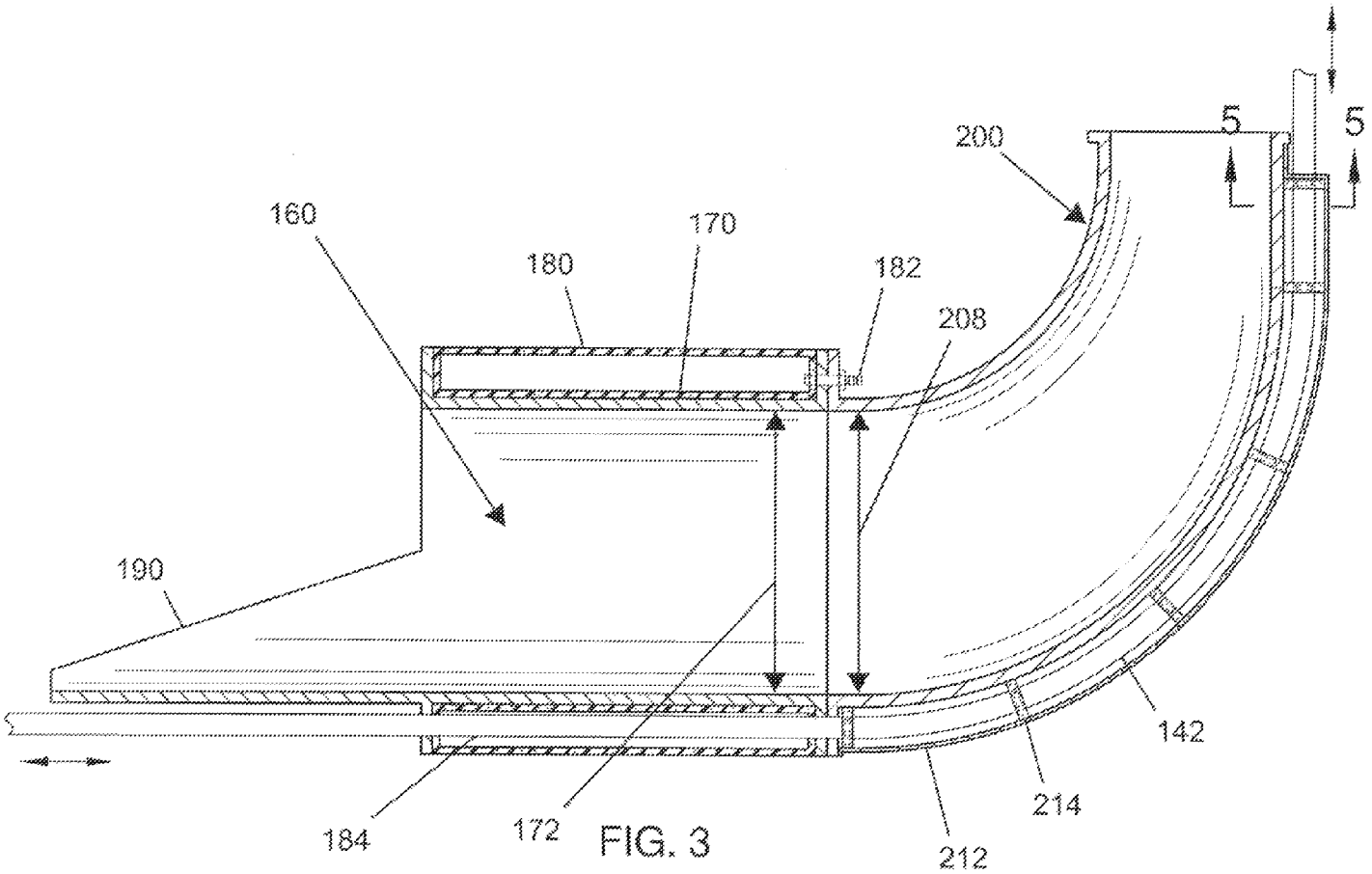
FIG. 3 shows a cross-section of the reducing elbow, the collar assembly, and the skirt of the present invention.
Figure 4:
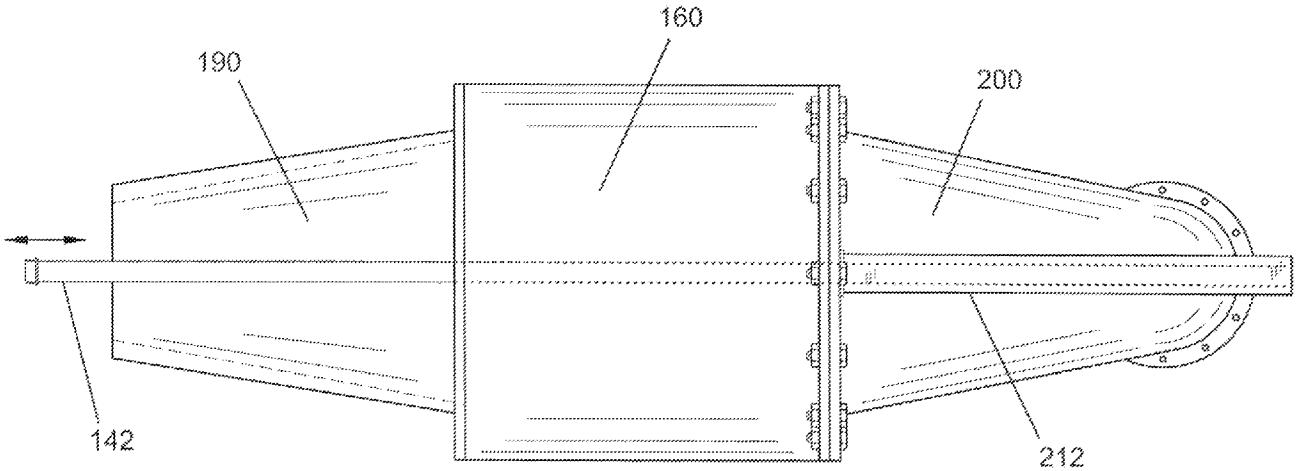
FIG. 4 shows a bottom view of the reducing elbow, the collar assembly, and the skirt of the present invention.
Figure 5:
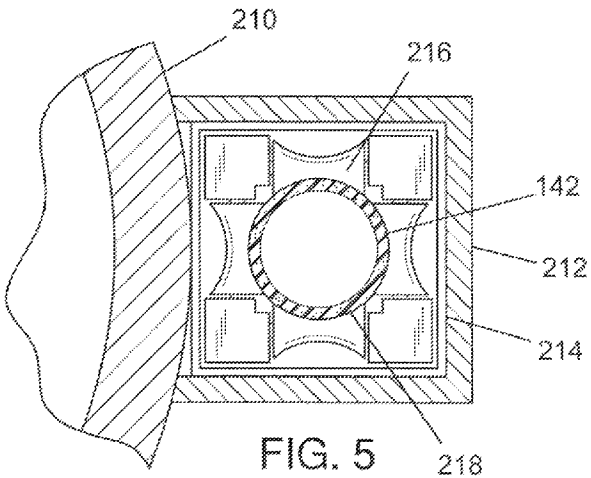
FIG. 5 shows a cross-section of the roller unit of the present invention.

Following is a list of elements corresponding to a particular element referred to herein:

100 Municipal sewer cleaning system
102 Manhole
104 Sewer line
110 Vacuum service truck
120 Vacuum source
122 Vacuum hose
124 Vacuum hose diameter
130 Compressed air source
132 Air hose
140 Pressurized water source
142 Water hose
150 Hose assembly
160 Collar assembly
162 Collar first end
164 Collar second end
170 Inner collar
172 Inner collar diameter
180 Outer collar
182 Quick connect fitting
184 Water hose channel
190 Skirt
192 Skirt first end
194 Skirt second end
200 Reducing elbow
202 Elbow first end
204 Elbow second end
206 First elbow diameter
208 Second elbow diameter
210 Elbow outside wall
212 Trough
214 Roller unit
216 Roller
218 Aperture Referring now to FIG. 1-5, the present invention features a municipal sewer cleaning system (100) for efficiently cleaning a below grade municipal sewer line. In some embodiments, the system (100) comprises a vacuum service truck (110). In some embodiments, the vacuum service truck (110) comprises a vacuum source (120) fluidly connected to a flexible vacuum hose (122). In some embodiments, the vacuum hose (122) comprises a vacuum hose diameter (124). In some embodiments, the vacuum service truck (110) comprises a compressed air source (130) fluidly connected to a flexible air hose (132). In some embodiments, the vacuum service truck (110) comprises a pressurized water source (140) fluidly connected to a flexible water hose (142). In some embodiments, the vacuum hose (122), the air hose (132), and the water hose (142) are collectively joined into a hose assembly (150) designed to extend into a below grade sewer line (104) from the vacuum service truck (110).

In some embodiments, the system (100) comprises a collar assembly (160) having a collar first end (162), a collar second end (164), a rigid inner collar (170), and an inflatable outer collar (180). In some embodiments, the inner collar (170) comprises an inner collar diameter (172). In some embodiments, the inner collar diameter (172) is 12 inches or less. In some embodiments, the inner collar diameter (172) is 14 inches. In some embodiments, the inner collar diameter (172) is 16 inches. In some embodiments, the inner collar diameter (172) is 18 inches or more.

In some embodiments, the inflatable outer collar (180) comprises a quick connect fitting (182) fluidly located thereon. In some embodiments, the quick connect fitting (182) is fluidly connected to the air hose (132). In some embodiments, the inflatable outer collar (180) is designed to fit inside and seal against 24 inch sewer lines. In some embodiments, the inflatable outer collar (180) is designed to fit inside and seal against 18 inch sewer lines. In some embodiments, the inflatable outer collar (180) is designed to fit inside and seal against 12 inch sewer lines. In some embodiments, the inflatable outer collar (180) is designed to fit inside and seal against 30 inch sewer lines.

In some embodiments, the system (100) comprises a tapering semi-cylindrical skirt (190) having a skirt first end (192) and a skirt second end (194). In some embodiments, the skirt first end (192) is located on the collar second end (164). In some embodiments, the skirt second end (194) extends out and away from the collar assembly (160). In some embodiments, the skirt (190) tapers from a semi-cylindrical skirt first end (192) to a terminating skirt second end (194).

In some embodiments, the system (100) comprises a rigid ninety-degree reducing elbow (200) having an elbow first end (202) and an elbow second end (204). In some embodiments, the elbow first end (202) comprises a first elbow diameter (206) equal to the vacuum hose diameter (124). In some embodiments, the elbow first end (202) is fluidly connected to the vacuum hose (122). In some embodiments, the elbow second end (204) comprises a second elbow diameter (208) equal to the inner collar diameter (172). In some embodiments, the elbow second end (204) is fluidly connected to the collar first end (162). In some embodiments, the reducing elbow (200) tapers from the elbow second end (204) to the elbow first end (202).

In some embodiments, the first elbow diameter (206) is 6 inches or less. In some embodiments, the first elbow diameter (206) is 8 inches. In some embodiments, the first elbow diameter (206) is 10 inches. In some embodiments, the first elbow diameter (206) is 12 inches. In some embodiments, the first elbow diameter (206) is 14 inches. In some embodiments, the first elbow diameter (206) is 15 inches. In some embodiments, the first elbow diameter (206) is 16 inches. In some embodiments, the first elbow diameter (206) is 18 inches. In some embodiments, the first elbow diameter (206) is 21 inches or more.

In some embodiments, the second elbow diameter (208) is 6 inches or less. In some embodiments, the second elbow diameter (208) is 8 inches. In some embodiments, the second elbow diameter (208) is 10 inches. In some embodiments, the second elbow diameter (208) is 12 inches. In some embodiments, the second elbow diameter (208) is 14 inches. In some embodiments, the second elbow diameter (208) is 16 inches. In some embodiments, the second elbow diameter (208) is 16 inches. In some embodiments, the second elbow diameter (208) is 18 inches. In some embodiments, the second elbow diameter (208) is 21 inches or more In some embodiments, the reducing elbow (200) comprises a trough (212) located on an elbow outside wall (210). in some embodiments, the trough (212) comprises a plurality of roller units (214) located therein. In some embodiments, the roller unit (214) comprises a plurality of radially located rollers (216) surrounding a centrally located aperture (218). in some embodiments, there are four rollers (216). In some embodiments, each roller (216) comprises a concavely arcuate surface located thereon. In some embodiments, the water hose (142) is located in the trough (212) through the plurality of roller units (214) where the plurality of rollers (216) in each roller units (214) interfaces with the water hose (142) for easy movement of the water hose (142) through the trough (212). In some embodiments, the water hose (142) slides through the aperture (218) created by the concavely arcuate rollers (218).

In some embodiments, for operation, the hose assembly (150), the collar assembly (160) with the skirt (190) located thereon, and the reducing elbow (200) are inserted into a manhole (102) for evacuating silt and debris in the sewer line (104). In some embodiments, the outer collar (180) is inflated via the air hose (132) and the compressed air source (130) for sealing the collar assembly (160) against an inner wall of the sewer tine (104). In some embodiments, silt and debris is mixed into a form of a slurry via the water hose (142) and pressurized water source (140). In some embodiments, the water hose (142) is moved in a back and forth motion inside the sewer line (104) via the roller units (214). In some embodiments, the slurry is vacuumed into the vacuum service truck (110) via the vacuum hose (122) and the vacuum source (120).

In some embodiments, the vacuum hose diameter (124) is 8 inches. In some embodiments, the first elbow diameter (208) is 8 inches. In some embodiments, the second elbow diameter (208) is 14 inches.

In some embodiments, the water hose (142) slidably passes through a water hose channel (184) located in the outer collar (180).

In some embodiments, inflation of the outer collar (180) isolates silt and debris and prevents it from entering into other sections of the sewer line (104). In some embodiments, the reducing elbow (200) is telescopically collapsible.

As used herein, the term "about" refers to plus or minus 10% of the referenced number.

The disclosures of the following U.S. Patents are incorporated in their entirety by reference herein: U.S. Pat. No. D 348,961; U.S. Pat. No. 6,702,939; U.S. Pat. No. 5,338,333; U.S. Pat. No. 4,322,868; U.S. Pat. No. 3,661,261; and U.S. Pat. No. 3,658,589.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. A municipal sewer cleaning system (100) for efficiently cleaning a below grade municipal sewer line, wherein the system (100) comprises:

(a) a vacuum service truck (110), wherein the vacuum service truck (110) comprises:

(i) a vacuum source (120) fluidly connected to a flexible vacuum hose (122), wherein the vacuum hose (122) comprises a vacuum hose diameter (124), (ii) a compressed air source (130) fluidly connected to a flexible air hose (132), and (iii) a pressurized water source (140) fluidly connected to a flexible water hose (142), wherein the vacuum hose (122), the air hose (132), and the water hose (142) are collectively joined into a hose assembly (150) designed to extend into a below grade sewer line (104) from the vacuum service truck (110);

(b) a collar assembly (160) having a collar first end (162), a collar second end (164), a rigid inner collar (170), and an inflatable outer collar (180), wherein the inner collar (170) comprises an inner collar diameter (172), wherein the inflatable outer collar (100) comprises a quick connect fitting (182) fluidly disposed thereon, wherein the quick connect fitting (182) is fluidly connected to the air hose (132);

(c) a tapering semi-cylindrical skirt (190) having a skirt first end (192) and a skirt second end (194), wherein the skirt first end (192) is disposed on the collar second end (164), wherein the skirt second end (194) extends out and away from the collar assembly (160), wherein the skirt (190) tapers from the semi-cylindrical skirt first end (192) to the terminating skirt second end (194); and (d) a rigid ninety-degree reducing elbow (200) having an elbow first end (202) and an elbow second end (204), wherein the elbow first end (202) comprises a first elbow diameter (206) equal to the vacuum hose diameter (124), wherein the elbow first end (202) is fluidly connected to the vacuum hose (122), wherein the elbow second end (204) comprises a second elbow diameter (208) equal to the inner collar diameter (172), wherein the elbow second end (204) is fluidly connected to the collar first end (162), wherein the reducing elbow (200) tapers from the elbow second end (204) to the elbow first end (202), wherein the reducing elbow (200) comprises a trough (212) disposed on an elbow outside wall (210), wherein the trough (212) comprises a plurality of roller units (214) disposed therein, wherein the roller unit (214) comprises a plurality of radially disposed rollers (216) surrounding a centrally disposed aperture (218), wherein each roller (216) comprises a concavely arcuate surface disposed thereon, wherein the water hose (142) is disposed in the trough (212) through the plurality of roller units (214) where the plurality of rollers (216) in each roller unit (214) interfaces with the water hose (142) for easy back and forth movement of the water hose (142) through the trough (212);

wherein for operation, the hose assembly (150), the collar assembly (160) with the skirt (190) disposed thereon, and the reducing elbow (200) are inserted into a manhole (102) for evacuating silt and debris from the sewer line (104), wherein the outer collar (180) is inflated via the air hose (132) and the compressed air source (130) for sealing the collar assembly (160) against an inner wall of the sewer line (104), wherein silt and debris is mixed into a form of a slurry via the water hose (142) and pressurized water source (140), wherein the water hose (142) is moved in a back and forth motion inside the sewer line (104) via the roller units (214), wherein the slurry is vacuumed into the vacuum service truck (110) via the vacuum hose (122) and the vacuum source (120).

2. The system (100) of claim 1, wherein the vacuum hose diameter (124) is 8 inches.

3. The system of claim 1, wherein the first elbow diameter (206) is 8 inches.

4. The system of claim 1, wherein the second elbow diameter (203) is 14 inches.

5. The system of claim 1, wherein the inner collar diameter (172) is 14 inches.

6. The system of claim 1, wherein the water hose (142) slidably passes through a water hose channel (184) disposed in the outer collar (180).

* * * * *